US008800668B2

(12) United States Patent
Bouldin et al.

(10) Patent No.: US 8,800,668 B2
(45) Date of Patent: Aug. 12, 2014

(54) PARTIALLY RETRIEVABLE SAFETY VALVE

(75) Inventors: Brett Wayne Bouldin, Dhahran (SA); Stephen Wayland Smith, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 314 days.

(21) Appl. No.: 13/022,197

(22) Filed: Feb. 7, 2011

(65) Prior Publication Data

US 2012/0199367 A1 Aug. 9, 2012

(51) Int. Cl.
*E21B 34/06* (2006.01)

(52) U.S. Cl.
USPC ..... 166/373; 166/316; 166/386

(58) Field of Classification Search
USPC ..... 166/374, 332.8
See application file for complete search history.

(56) References Cited

U.S. PATENT DOCUMENTS

| | | | | |
|---|---|---|---|---|
| 3,375,874 | A | 4/1968 | Cherry et al. | |
| 4,407,329 | A | 10/1983 | Huebsch et al. | |
| 4,566,534 | A | 1/1986 | Going, III | |
| 4,625,798 | A | 12/1986 | Bayh, III | |
| 4,641,707 | A | 2/1987 | Akkerman | |
| 4,886,114 | A | 12/1989 | Perkins et al. | |
| 5,070,595 | A | 12/1991 | Perkins et al. | |
| 5,070,944 | A | 12/1991 | Hopper | |
| 5,230,383 | A | 7/1993 | Pringle et al. | |
| 5,465,786 | A | 11/1995 | Akkerman | |
| 5,881,814 | A | 3/1999 | Mills | |
| 6,095,250 | A * | 8/2000 | Day et al. | 166/321 |
| 6,234,247 | B1 | 5/2001 | Head | |
| 6,328,111 | B1 | 12/2001 | Bearden | |
| 6,619,388 | B2 | 9/2003 | Dietz et al. | |
| 2002/0050361 | A1 | 5/2002 | Shaw et al. | |
| 2009/0229814 | A1 | 9/2009 | Going, III | |
| 2009/0301735 | A1 * | 12/2009 | Trapp | 169/5 |
| 2010/0025045 | A1 | 2/2010 | Lake et al. | |

FOREIGN PATENT DOCUMENTS

WO WO 2010123587 A2 * 10/2010

OTHER PUBLICATIONS

Partial International Search Report in PCT/US2012/023941 dated Jan. 4, 2013.

* cited by examiner

*Primary Examiner* — Jennifer H Gay
*Assistant Examiner* — Caroline Butcher
(74) *Attorney, Agent, or Firm* — Bracewell & Giuliani LLP; Constance G. Rhebergen; Taylor P. Evans

(57) ABSTRACT

A method, system and apparatus is provided for a partially retrievable safety valve to control a well. The method includes securing a normally closed valve in the well. The valve may be a self-equalizing flapper valve. Following this, an actuator system operable to open the valve is run into the well. The actuator system is removable from the well while the valve remains closed and secured in the well. A submersible pump and motor may be secured to the actuator system before the actuator system is run into the well. The submersible pump and motor are also removable from the well while the valve remains closed and secured in the well. Therefore the actuator system, submersible pump and motor can be replaced or redressed, while the valve remains closed, keeping the well under control at all times.

30 Claims, 3 Drawing Sheets

PARTIALLY RETRIEVABLE SAFETY VALVE

BACKGROUND OF THE INVENTION

1. Area of the Invention

The present invention relates to deep-set safety valves used in subterranean well production. More specifically, the present invention relates to deep-set safety valves used in connection with submersible pumps for controlling a well.

2. Description of the Related Art

In subsurface wells, such as oil wells, an electrical submersible pump with a motor (an "ESP") is often used to provide an efficient form of artificial lift to assist with lifting the production fluid to the surface. ESPs decrease the pressure at the bottom of the well, allowing for more production fluid to be produced to the surface than would otherwise be produced if only the natural pressures within the well were utilized.

There may be times when an operator of a well would want or need to retrieve an ESP from within the well. In order to do so, the operator must have a means for closing off the well so that the production fluid does not still flow to the surface, while the ESP is retrieved. Killing the well may be accomplished by pumping heavy fluids into the well to overbalance the subterranean pressure. But that method can cause formation damage so it is therefore more desirable to control the well than to kill it. Maintaining control of a well with an umbilical-deployed ESP would normally require the use of a deep set subsurface safety valve (SSSV) or other shut-off valve that would be set below the ESP to shut-in the well first so that the ESP could be retrieved. Normally deep-set safety valves are controlled via a single ¼" OD hydraulic umbilical to the surface, but at deep depths, the hydraulic pressures are very high and even when the hydraulic system fails, the magnitude of residual hydraulic pressure can be significant. In such a system, the springs that return the valve to the closed position must be capable of overcoming the residual hydrostatic pressure in order to shut-in the well in an emergency situation. Therefore, the deeper the well, the higher the pressure, and the stronger the spring system must be to lift the hydraulic fluid column to close the valve and shut-in the well. There will also come a point when the hydraulic pressures would be so great that a spring system would become very difficult to implement and eventually become unfeasible. Springs can generally be constructed as either plain mechanical or mechanical plus gas-charge assisted.

One way to solve this deep setting problem is to use an electrically activated subsurface safety valve (E-SSSV). E-SSSVs are usually powered via a ¼" tubing encased conductor (TEC) which is a hydraulic umbilical with one or more electric wires inside, Electrical wet connectors can be a source of failure in a well system and can be cumbersome to work with so it would be advantageous for a system to operate without the need for a wet connector if the components that activate the E-SSSV need to be retrieved, for example, for maintenance or repair.

Also, a typical failure mode of most flapper-type safety valves is the flow tube becomes stuck to the valve mandrel, sticking the valve open. This is because typical deep-set safety valve systems do not have excessive force available to push the flow tube upward and free it from wellbore contaminants such as asphaltines, scale, and packed fines.

Prior art safety valves are configured in only two methods; either wireline retrievable or tubing retrievable. Both the prior art hydraulic and electrical safety valves are provided with a dedicated method of control, that is, the connection between the surface and the valve is not shared with any other downhole component. This creates additional time and cost associated with requiring multiple connection components and may also raise design issues in finding space to route multiple control lines downhole.

Some prior art flapper safety valves also require the pressure to be equalized on either side of the valve before it can be opened. This requires passageways that connect the space above and below the flapper. This in turn creates additional components, including a valve means for opening and closing this passageway and a means for activating such valve. It would be advantageous to avoid the need for such equalization.

In addition, with the prior art methods, normally the well must be killed and a full rig used to pull the tubing string when an ESP replacement is required. It would be advantageous to neither to kill the well, nor require a rig to replace an ESP completion.

Therefore a problem exists of how to provide fail-safe well control for a live well intervention on an assisted ESP artificial lift, which was umbilical deployed.

SUMMARY OF THE INVENTION

Applicants appreciate the importance of providing a reliable deep-set safety valve and have provided methods and apparatuses that can be instrumental in providing such a valve while also providing for a method and apparatus that allows the efficient retrieval, removal and replacement of an actuator system, and an ESP, consisting of a submersible pump and motor, used in connection with such valve.

The present concept provides for a very reliable means for a safety valve, allowing the actuator system to be removed and redressed periodically with the ESP during routine rigless replacement of the actuator system and ESP. The system can be installed and removed without a rig.

The current application provides a solution where there is no need or opportunity to open the valve if the ESP or actuator system is not functional. Instead, the ESP, if any, and actuator system would simply be removed and redressed. The ESP and actuator system can be replaced or redressed, while the valve remains closed, keeping the well under control at all times. The system of the current application provides a safety valve that can be controlled with the same communication conduit that controls the ESP.

After a subterranean well is cased, a packer may be run and set in the well. The packer may comprise a polished bore receptacle and the valve of one of the embodiments of this application. Next, an upper tubing string is run into the well and secured to the packer via a polished bore receptacle with tubing seals. Alternatively, the embodiments of the current application can be used in an uncased subterranean well.

In one embodiment of the current application, a normally closed valve is secured in the well. The valve may be a self-equalizing flapper valve or a member of the generic globe valve family. A globe valve may be, for example, a butterfly valve or a ball valve. Following this, an actuator system operable to open the valve is run into the well. The actuator system is removable from the well while the valve remains closed and secured in the well. An ESP may be secured to the actuator system before the actuator system is run into the well. The ESP is also removable from the well while the valve remains closed and secured in the well.

The actuator system may include a communication conduit. The communication conduit may be, for example, a three-phase electrical umbilical, a single electrical umbilical, or hydraulic line. If the communication conduit comprises a three phase electrical umbilical, the communication conduit can be used for sending a signal to activate the ESP.

In one embodiment, the actuator system may include a normally disengaged clutch, a normally unlocked locking system and a communication conduit. The communication conduit may used to engage the locking system and secure the actuator system in the well. A loss of signal in the communication conduit will caused the valve, the locking system, and clutch to return to their respective normal positions.

In an alternative embodiment, the actuator system further comprises a return spring and a flow tube. A signal sent through the communication conduit will cause the flow tube to move to a lower position to come in contact with and open the valve. Upon a loss of a signal in the communication conduit, the return spring will return the flow tube to an upper position and the valve will close.

Either upon the loss of a signal in the communication conduit or by the operator sending a signal by way of the communication conduit for the locking system, valve and clutch to return to their respective normal positions, the actuator system and the ESP can be retrieved from the well. The actuator system and ESP can then be maintained, repaired, or replaced and returned to the well as discussed above. The actuator system and the ESP can be retrieved from the well by spooling the communication conduit out of the well with a wireline truck. An over-pull on the communication conduit may be required to release the actuator system and the ESP from the well. Similarly, the running of the actuator system and the ESP into the well can also be performed with a wireline truck. No rig is required for either operation.

In another embodiment, the partially retrievable safety valve system for controlling a subterranean well includes a normally closed valve and an actuator system operable to open the valve. The actuator system is removable from the well while the valve remains closed and secured in the well. An ESP may be secured to the actuator system. The ESP is also removable from the well while the valve remains closed and secured in the well.

The actuator system may comprise a communication conduit, an actuator motor, a clutch, and a locking system. The valve may be either a flapper valve or a valve from the generic family of globe valves. The communication conduit may comprise either an electrical umbilical or a hydraulic line. The communication conduit communicates with the ESP motor, the actuator motor, the clutch, and the locking system. The actuator system is removable from the well by the communication conduit.

In an additional embodiment, the actuator system further comprises an actuator and a flow tube. The communication conduit is operable to transfer a signal to the actuator motor to move the actuator to a lower position. The actuator, when moving to its lower position, causes the flow tube to move to a lower position and the flow tube, when in its lower position, maintains the valve in an open position.

In an alternative embodiment, the actuator system further comprises a return spring operable to return the flow tube to an upper position upon the loss of communication in the communication conduit.

In another embodiment, the partially retrievable safety valve for controlling a subterranean well comprises a packer comprising a polished bore receptacle and a normally closed valve, an actuator system operable to open the valve, and a normally unlocked locking system securing the actuator system in the well. The actuator system is removable from the well while the valve remains closed and secured in the well.

The actuator system may comprise an actuator motor, a normally disengaged clutch, a flow tube, and a communication conduit. The communication conduit is capable of communication with the actuator motor, locking system, and clutch. The clutch and valve are in their respective normal positions when a signal in the communication conduit is lost.

In an additional embodiment, the actuator system further comprises a flow tube. The flow tube has an upper position and lower position such that when the flow tube is in the upper position, the valve is closed and when the flow tube is in the lower position, the valve is open. The actuator system may further comprise a return spring operable to return the flow tube to an upper position when a signal in the communication conduit is lost.

BRIEF DESCRIPTION OF THE DRAWINGS

So that the manner in which the features and advantages of the invention, as well as others which will become apparent are attained and can be understood in more detail, a more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Embodiments of the Present System and Method Include

Figure 1:
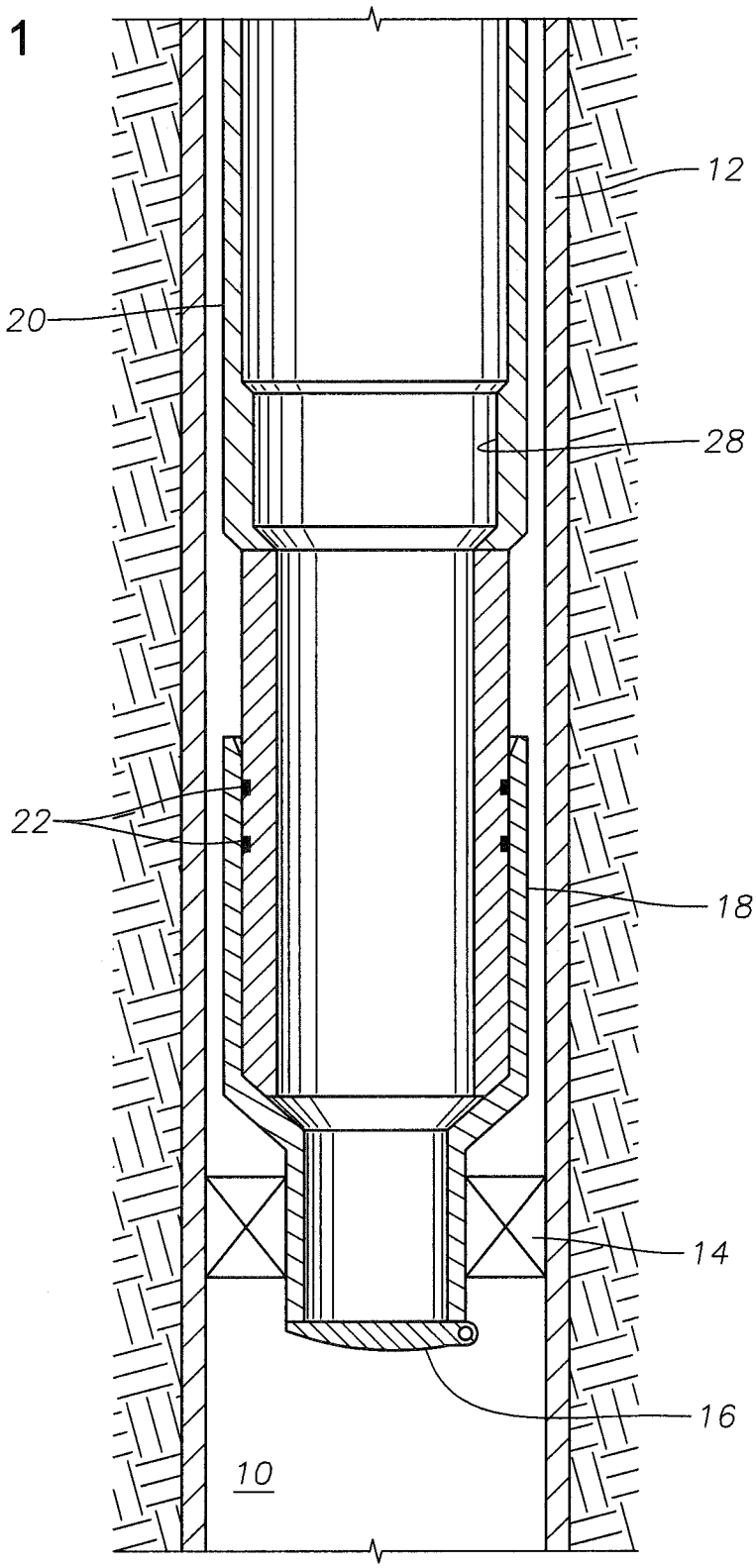
FIG. 1 is a sectional view of an embodiment of the present system and method.

As seen in FIG. 1, the system may be employed in a cased well 10 with casing 12. Components installed in such a well 10 may include a packer 14 with integral valve 16. Valve 16 is shown as a flapper valve but may alternatively be any valve in the generic globe valve family. A globe valve may be, for example, a butterfly valve, a gate valve or a ball valve. Packer 14 has a polished bore receptacle 18 at its upper end. A tubing string 20 is connected to the polished bore receptacle 18. This connection may be made as the tubing string 20, which has a lower outer diameter slightly smaller than the inner diameter of the polished bore receptacle 18, comes into sliding engagement with the polished bore receptacle 18 as the tubing string 20 is lowered into the well 10. The bottom of tubing string 20 has a reduced diameter compared to the upper portion of the tubing string 20, to allow for this sliding engagement with the polished bore receptacle 18. Seals 22 create a seal between the base of the outside diameter of the base of the tubing string 20 and the inside diameter of the polished bore receptacle 18.

Figure 2:
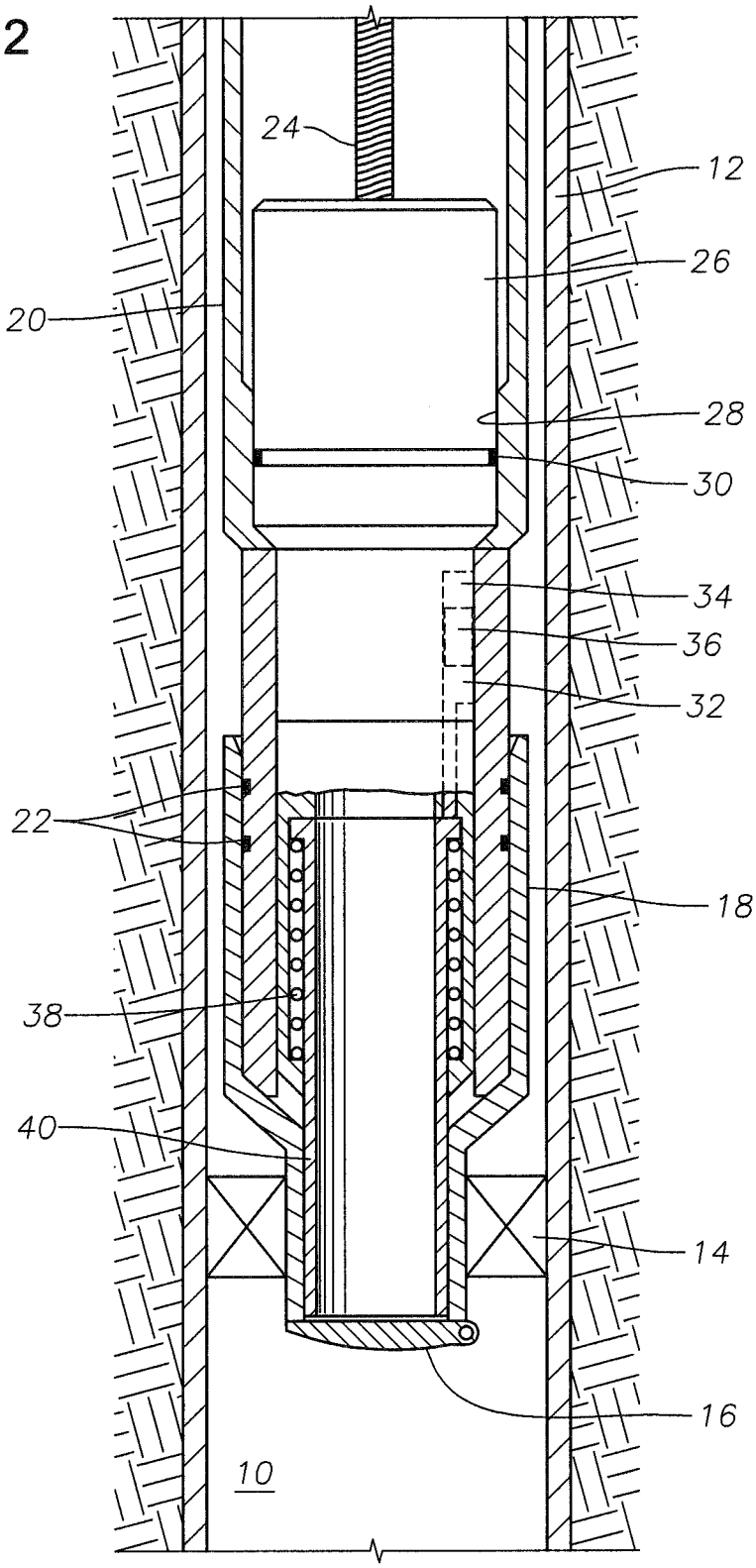
FIG. 2 is another sectional view of an embodiment of the present system and method.

Turning to FIG. 2, the ESP assembly is shown to include, an ESP, which comprises a submersible pump and motor 26, and an actuator system. Seals 30 create a seal between the ESP assembly and the tubing string 20. The actuator system includes a communication conduit 24, a safety valve actuator motor 34, clutch and locking system 36, actuator 32, return spring 38, and flow tube 40. The locking system may comprise an anchor, as it is referred to herein, but it may also be an alternative locking means known in the art. Actuator 32 may be a ball screw actuator or alternative appropriate actuator known in the art. The return spring 38 may be a power spring. The ESP assembly as show in FIG. 2 is in the closed position. Valve 16 is closed so that the production fluid in the lower portion of well 10 cannot enter the inlet 42 (shown in FIG. 3) in the bottom of the flow tube of the ESP assembly. The communication conduit 24 is communicatively connected to each of the submersible pump and motor 26, the actuator motor 34, and the clutch and anchor 36, and the communication conduit 24 can transfer a signal to each of these components. Therefore this single source can effectively operate the ESP 26, the actuator system, and the valve 16.

Figure 3:
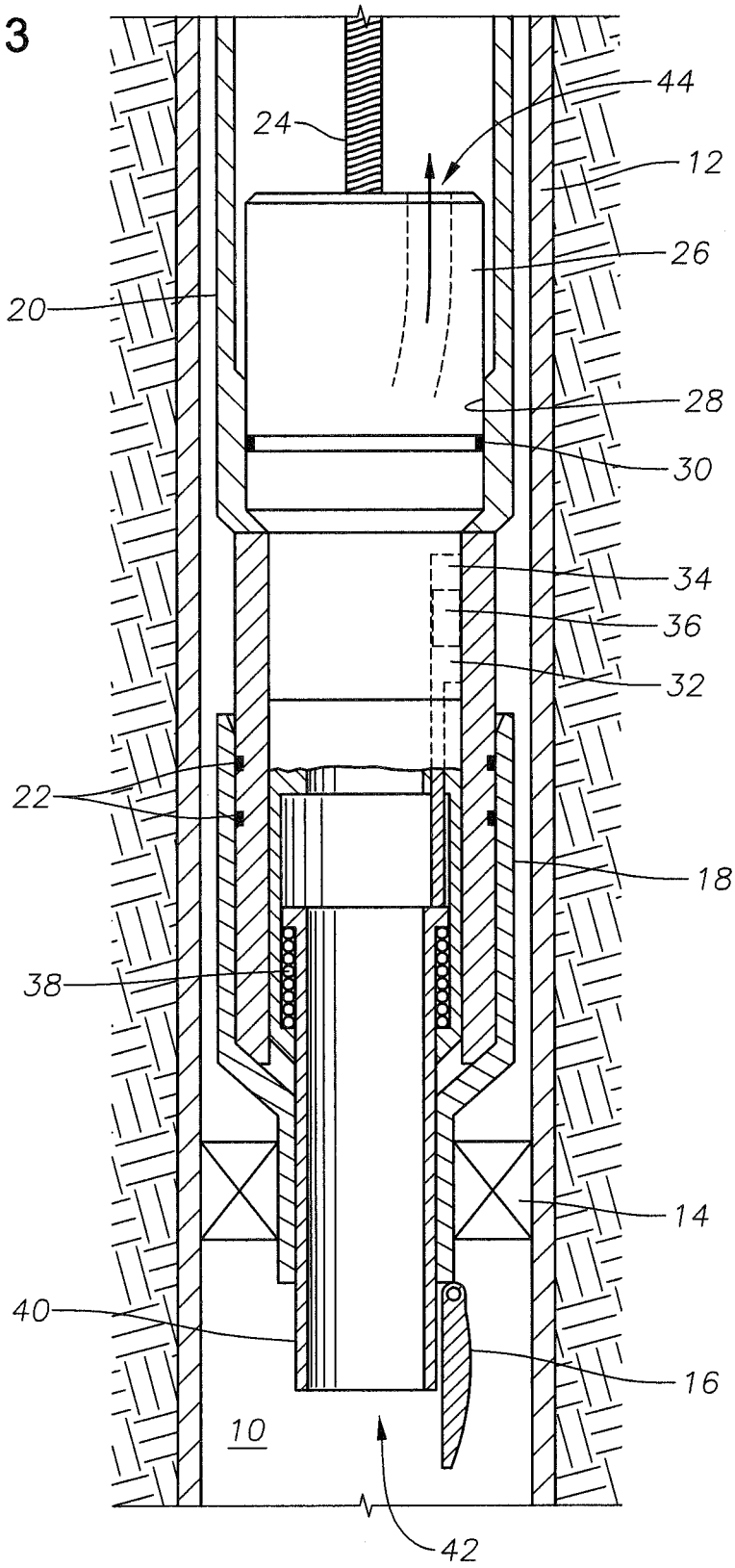
FIG. 3 is another sectional view of an embodiment of the present system and method.

The ESP assembly is shown in FIG. 3 in the open position. Actuator 32 is holding the flow tube 40 in a lower position, forcing valve 16 open and putting return spring 38 in a stressed mode, with stored potential energy. With valve 16 in the open position, production fluid enters the inlet 42. The production fluid is artificially lifted by the submersible pump and motor 26 and leaves the ESP assembly at exit 44. If a signal to the ESP assembly is lost, the clutch will disengage, the anchor will unlock, the actuator 32 will no longer hold the flow tube 40 in the lower position, and the return spring 38 will force the flow tube 40 to an upper position, causing the valve 16 to close and the ESP system to return to the embodiment shown in FIG. 2.

In operation, a well 10 is drilled and lined with casing 12 by traditional means. After the well 10 is lined with casing 12, the packer 14 with the valve 16 is run into the well 10 and secured to the casing 12 by traditional means. Next, the tubing string 20 is run into the well 10 and stabbed into the polished bore receptacle 18 in the packer 14. When the tubing string 20 is fully engaged with the polished bore receptacle 18, seals 22 create a fluid tight seal between the outer diameter of the tubing string 20 and the inner diameter of the polished bore receptacle 18. After the tubing string 20 has been fully run into the well 10, a rig is no longer required to perform any other step in this method. Contrary to the requirements of prior art, where pumps and valves are run into and out of the well on tubing strings, for the embodiments of the present application, the rig may be released, if desired, and the rig will not be required in order to remove the ESP assembly, including the ESP and actuator components, for maintenance or repair.

The next step of the current method is to lower the ESP assembly into the well 10. The ESP assembly may be lowered into the well 10 on a communication conduit 24 using a wireline truck. The ESP assembly lands in the seal bore 28, adjacent to the seals 30 as seen in FIG. 2. The anchor is then activated to lock the ESP assembly into the seal bore 28. Seals 30 create a fluid tight seal between the ESP assembly and the tubing string 20.

Next, the clutch and the actuator motor 34 are activated and the actuator 32 is operated to move the flow tube 40 down to its lower position. The actuator motor 34 will allow for control of the actuator 32, enabling the operator to move the actuator 32 to and from its upper position and its lower position. The clutch is a normally unengaged device and a signal must be maintained in the communication conduit for the clutch to remain engaged. When the actuator 32 is in its lower position, it applies force to the return spring 38, storing potential energy in the return spring 38. When the actuator 32 is in its lower position, it forces the flow tube 40 downward and the flow tube 40 comes into contact with the valve 16, causing the valve 16 to open and to remain open for so long as the flow tube 40 is in its lower position. If a signal in the communication conduit is lost, the return spring 38 has sufficient force and stored energy to reposition the flow tube 40 to its upper position causing the valve 16 to close.

After the valve 16 has been opened, production fluids will enter through the inlet 42 and exit through the exit 44. If there is sufficient natural pressure, the production fluids will continue traveling upwards through the tubing string 20 to the surface. After the valve 16 has been opened the submersible pump and motor 26 may be started and will provide artificial lift to the production fluids to further force the production fluid up the tubing string 20 to the surface. The submersible pump and motor 26 will only continue to run and supply artificial lift to the production fluid if the signal in the communication conduit is maintained. Signals to the ESP assembly, including the clutch and anchor 36, the actuator motor 34, and the submersible pump and motor 26 are all provided by communication conduit 24.

In the case of a loss of a signal the communication conduit, the submersible pump and motor 26 stop, the anchor unlocks, and the clutch disengages. Although the anchor unlocks, it remains engaged. A slight over-pull is required for the anchor to become unengaged. With the clutch disengaged, the return spring 38 strokes flow tube 40 to its upper position, allowing valve 16 to close. This method thus provides a fail-safe closed device.

If the operator desires to close the valve 16 purposefully, a command can be sent by way of the communication conduit 24 to the actuator motor 34, causing the actuator 32 to be stroked to its upper position, which in turn causes the flow tube 40 to move to its upper position, and close the valve 16. Upon reestablishment of a signal to the ESP assembly via the communication conduit 24, the clutch and anchor 36 is reengaged, the actuator motor 34 causes the actuator 32 to move to its lower position, forcing the flow tube 40 downward, while also applying force to the return spring 38. The flow tube 40 comes into contact with the valve 16, causing the valve 16 to open and to remain open for so long as the flow tube 40 remains in its lower position.

As discussed above, a loss of a signal in the communication conduit 24 will unlock the anchor. Alternatively, the operator may send a signal via the communication conduit 24 to unlock the anchor. In either case, if the operator wishes to then remove the ESP assembly, a slight over-pull on the communication conduit 24 will release the ESP assembly from the seal bore 28, allowing the ESP assembly to be spooled out of the well 10 via the communication conduit 24. If over-pull on the communication conduit 24 is unsuccessful to remove the ESP assembly, then the communication conduit 24 will be further pulled and a weak point at the top of the ESP assembly, called a rope socket, will release the communication conduit 24, permitting it to be retrieved. Next a rig will be brought on and a workover string run with an overshot to latch onto the ESP rope socket and retrieve it from the well. When the ESP assembly is removed, the valve 16 remains closed, keeping well 10 under control. If the operator wishes to return the ESP assembly to the well 10, the same procedure used to set the ESP assembly in the well 10 initially can be repeated.

The foregoing has broadly outlined certain objectives, features, and technical advantages of the present invention and a detailed description of the invention so that embodiments of the invention may be better understood in light of features and advantages of the invention as described herein, which form the subject of certain claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages is better understood from the following description when considered in connection with the accompanying figures. It is to be expressly understood, however, that such description and figures are provided for the purpose of illustration and description only and are not intended as a definition of the limits of the present invention.

That claimed is:

1. A system for providing control of the flow of fluid in a subterranean well comprising:

a normally dosed valve secured in the well that allows or restricts flow of the fluid through the well when in the open and closed positions, respectively;

an actuator system operable to open the valve, and removable from the well while the valve remains closed and secured in the well, the actuator system comprising:

an actuator motor, an actuator moved by the actuator motor between an upper actuator position and a lower actuator position;

a hollow flow tube connected to the actuator and having an upper flow tube position and a lower flow tube position, the hollow flow tube communicating with the actuator so that when the actuator moves to the lower actuator position, the hollow flow tube moves to the lower flow tube position, directly contacts the valve, and pushes the valve open, the hollow flow tube maintaining the valve open when in the lower flow tube position, so that fluid flows through the hollow flow tube and is in direct contact with the hollow flow tube, and allowing the valve to close when in the upper flow tube position.

2. The system of claim 1, further comprising a submersible pump and motor secured to the actuator system, wherein the submersible pump and motor are removable from the well while the valve remains closed and secured in the well.

3. The system of claim 2, wherein the actuator system comprises a communication conduit and wherein the communication conduit communicates with the submersible pump and motor.

4. The system of claim 1, wherein the actuator .system comprises a communication conduit, an actuator motor, a clutch, and a locking system, and wherein the communication conduit communicates with at least one of the actuator motor, the clutch, and the locking system.

5. The system of claim 4, wherein the communication conduit is an electrical umbilical.

6. The system of claim 4, wherein the communication conduit is a hydraulic line.

7. The system of claim 4, wherein the actuator system is removable from the well by the communication conduit.

8. The system of claim 4, wherein the communication conduit is operable to transfer a signal to the actuator motor to move the actuator to a lower position.

9. The system of claim 8, wherein the actuator system further comprises a return spring operable to return the flow tube to an upper position upon the loss of communication in the communication conduit.

10. The system of claim l, wherein the valve is a flapper valve.

11. The system of claim 1, wherein the valve, is a globe, valve.

12. A method for controlling the flow of fluid in a subterranean well comprising the steps of:

(a) securing a normally closed valve in the well, the valve allowing or restricting flow of the fluid through the well when in the open and closed positions respectively; and (b) running an actuator system, operable to open the valve, into the well, the actuator system being removable from the well while the valve remains closed and secured in the well, the actuator system comprising:

an actuator motor, an actuator moved by the actuator motor between an upper actuator position and a lower actuator position;

a hollow tube connected to the actuator and having an upper flow tube position and a lower flow tube position, the hollow flow tube communicating with the actuator so that when the actuator moves to the lower actuator position, the hollow flow tube moves to the lower flow tube position, directly contacts the valve, and pushes the valve open, the hollow flow tube maintaining the valve open when in the lower flow tube position so that fluid flows through the hollow flow tube and is in direct contact with the hollow flow tube, and allowing the valve to close when in the upper flow tube position.

13. The method of claim 12, further comprising the step of securing a submersible pump and motor to the actuator system, the submersible pump and motor being removable from the well while the valve remains closed and secured in the well.

14. The method of claim 13, wherein the actuator system comprises a communication conduit, the method further comprising the step of sending a signal through the communication conduit to activate the submersible pump and motor.

15. The method of claim 14, wherein the step of retrieving of the actuator system and the submersible pump and motor is performed by spooling the communication conduit out of the well.

16. The method of claim 13, further comprising the steps of:

retrieving the actuator system and the submersible pump and motor from the well while the valve remains closed and secured in the well;

performing maintenance or repairs on at least one of the actuator system and the submersible pump and motor; and running the actuator system and the submersible pump and motor into the well, the actuator system being removable from the well while the valve remains closed and secured in the well.

17. The method of claim 12, wherein the actuator system comprises an electrical umbilical, the method further comprising the step of sending a signal through the electrical umbilical to open the valve.

18. The method of claim 12, wherein the actuator system comprises a hydraulic line, the method further comprising the step of sending a signal through the hydraulic line to open the valve.

19. The method of claim 12, wherein:

the actuator system further comprises a normally disengaged clutch and a normally unlocked, locking system, and a communication conduit; and the method further comprises the step of retrieving the actuator system from the well following a loss of a signal in the communication conduit which caused the valve, the locking system, and clutch to return to their respective normal positions.

20. The method of claim 12, wherein the actuator system comprises a communication conduit, a clutch, and a locking system, the method further comprising the step of sending a signal through the communication conduit to engage the looking system and secure the actuator system in the well.

21. The method of claim 12, wherein the actuator system further comprises a communication conduit and a return spring, and wherein the method further comprises sending a signal through the communication conduit to cause the flow tube to move to a lower position to come in contact with and open the valve, such that upon a loss of a signal in the communication conduit, the return spring will return the flow tube to an upper position and the valve will close.

22. The method of claim 12, wherein:

the actuator system further comprises a communication conduit;

the valve is a normally closed flapper valve; and the method further comprises the step of sending a signal through the communication conduit to open the flapper valve.

23. The method of claim 12, wherein:

the actuator system further comprises a communication conduit;

the valve is a normally closed globe valve; and the method :further comprises the step of sending a signal through the communication conduit to open the globe valve.

24. An apparatus for controlling the flow of fluid in a subterranean well comprising:

a packer securely attached to a normally closed valve that allows or restricts flow of the fluid through the well when and closed positions, respectively;

an actuator system operable to open the valve, the actuator system comprising:

an actuator motor;

an actuator moved by the actuator motor between an upper actuator position and a lower actuator position;

a hollow flow tube connected to the actuator and having an upper flow tube position, and a lower flow tube position, the hollow flow tube communicating with the actuator so that when the actuator moves to the lower actuator position, the hollow flow tube moves to the lower flow tube position, directly contacts the valve, and pushes the valve open, the hollow flow tube maintaining the valve open when in the lower flow tube position so that fluid flows through the hollow flow tube and is in direct contact with the hollow flow tube, and allowing the valve to close when in the upper flow tube position; and a normally unlocked locking system securing the actuator system in the well, wherein the actuator system is removable from the well while the valve remains closed and secured in the well.

25. The apparatus of claim 24, wherein the actuator system further comprises a normally disengaged clutch and a communication conduit.

26. The apparatus of claim 25, wherein the communication conduit is an electrical umbilical.

27. The apparatus of claim 25, wherein the communication conduit is a hydraulic line.

28. The apparatus of claim 25, wherein the communication conduit is capable of communication with the actuator motor, locking system, and clutch.

29. The apparatus of claim 25, wherein the locking system, clutch, and valve are in their respective normal positions when a signal in the communication conduit is lost.

30. The apparatus of claim 24, wherein the actuator system further comprises a return spring operable t return the flow tube to an upper position when a signal in the communication conduit is lost.

* * * * *

UNITED STATES PATENT AND TRADEMARK OFFICE

CERTIFICATE OF CORRECTION

PATENT NO. : 8,800,668 B2
APPLICATION NO. : 13/022197
DATED : August 12, 2014
INVENTOR(S) : Brett Wayne Bouldin and Stephen Wayland Smith It is certified that error appears in the above-identified patent and that said Letters Patent is hereby corrected as shown below:

In the Claims:

In Column 7, Line 8, the word "doses" should read --closed--.

In Column 7, Line 25, the line appears as "tube position, so that fluid flows through the hollow" and should read --tube position so that fluid flows through the hollow--.

In Column 7, Line 37, the line appears as "The system of claim 1, wherein the actuator .system" and should read --The system of claim 1, wherein the actuator system--.

In Column 7, Line 57, the line appears as "The system of claim 1, wherein the valve, is a globe," and should read --The system of claim 1, wherein the valve is a globe--.

In Column 7, Line 63, the line appears as "when in the open and closed positions respectively; and" and should read --when in the open and closed positions, respectively; and--.

In Column 8, Line 1, the line appears as "an actuator motor," and should read --an actuator motor;--.

In Column 8, Line 4, the line appears as "a hollow tube connected to the actuator and having an" and should read --a hollow flow tube connected to the actuator and having an--.

In Column 8, Line 51, the line appears as "gaged clutch and a normally unlocked, locking device" and should read --gaged clutch and a normally unlocked locking device--.

In Column 8, Line 62, the first word appears as "looking" and should read --locking--.

In Column 9, Line 15, the line appears as "the method :further comprises the step of sending a signal" and should read --the method further comprises the step of sending a signal--.

Signed and Sealed this
Eighteenth Day of November, 2014

Michelle K. Lee

Michelle K. Lee
*Deputy Director of the United States Patent and Trademark Office*

In Column 9, Lines 21-22, the lines appear as "allows or restricts flow of the fluid through the well when and closed positions, respectively;" and should read --allows or restricts flow of the fluid through the well when in the open and closed positions, respectively;--.

In Column 10, Line 27, the line appears as "further comprises a return spring operable t return the flow" and should read --further comprises a return spring operable to return the flow--.